United States Patent [19]

Horvath et al.

[11] Patent Number: 4,487,550

[45] Date of Patent: Dec. 11, 1984

[54] COOLED TURBINE BLADE TIP CLOSURE

[75] Inventors: Richard L. Horvath, Hamilton; Robert W. Harris, Fairfield, both of Ohio

[73] Assignee: The United States of America as represented by the Secretary of the Air Force, Washington, D.C.

[21] Appl. No.: 461,424

[22] Filed: Jan. 27, 1983

[51] Int. Cl.[3] ..... F01D 5/18; F01D 5/20

[52] U.S. Cl. ..... 416/92; 416/97 A

[58] Field of Search ..... 416/92, 97 A, 95-97, 416/228, 232; 415/172 A, 174

[56] References Cited

U.S. PATENT DOCUMENTS

| | | | |
|---|---|---|---|
| 2,613,058 | 10/1952 | Atkinson | 416/92 |
| 2,618,462 | 11/1952 | Kane | 416/92 |
| 2,823,894 | 2/1958 | Gerdan et al. | 416/92 |
| 3,574,482 | 4/1971 | Savage et al. | 416/90 |
| 3,626,568 | 12/1971 | Silverstein et al. | 29/156.8 H |
| 3,672,787 | 6/1972 | Thorstenson | 416/97 A |
| 3,709,632 | 1/1973 | Emmerson et al. | 416/97 A |
| 3,810,711 | 5/1974 | Emmerson et al. | 416/97 A |
| 3,876,330 | 4/1975 | Pearson et al. | 416/92 |
| 3,899,267 | 8/1975 | Dennis et al. | 416/92 |
| 3,950,114 | 4/1976 | Helms | 416/97 A |
| 3,982,851 | 9/1976 | Andersen et al. | 416/92 |
| 4,010,531 | 3/1977 | Andersen et al. | 29/156.8 H |
| 4,067,662 | 1/1978 | Rossmann | 416/97 A |
| 4,073,599 | 2/1978 | Allen et al. | 416/97 R |
| 4,142,824 | 3/1979 | Andersen | 416/97 R X |
| 4,169,020 | 9/1979 | Stalker et al. | 416/92 X |
| 4,247,254 | 1/1981 | Zelahy | 416/97 R |
| 4,390,320 | 6/1983 | Eiswerth | 416/97 R |
| 4,411,597 | 10/1983 | Koffel et al. | 416/97 R X |

FOREIGN PATENT DOCUMENTS

| | | | |
|---|---|---|---|
| 1276200 | 6/1972 | United Kingdom | 416/92 |
| 1285369 | 8/1972 | United Kingdom | 416/92 |
| 2038957 | 7/1980 | United Kingdom | 416/97 A |

*Primary Examiner*—Everette A. Powell, Jr.

*Attorney, Agent, or Firm*—Donald J. Singer; Bobby D. Scearce

[57] ABSTRACT

An improved high pressure turbine rotor blade and tip cap structure therefor is provided, which comprises, a plurality of metallic layers bonded to the tip end of the blade, each layer having a peipheral shape conforming to the camber of the blade, the layers defining a plurality of radially outwardly opening, serpentine-shaped passageways for passage of coolant fluid through the periphery of the tip end of the blade.

8 Claims, 9 Drawing Figures

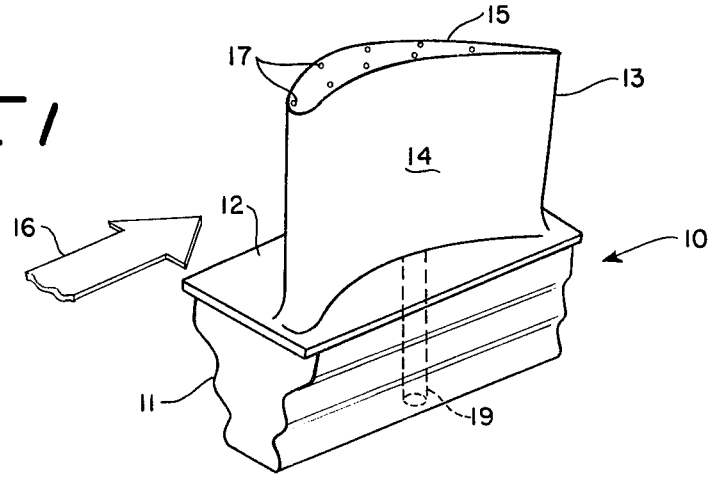
Fig. 1
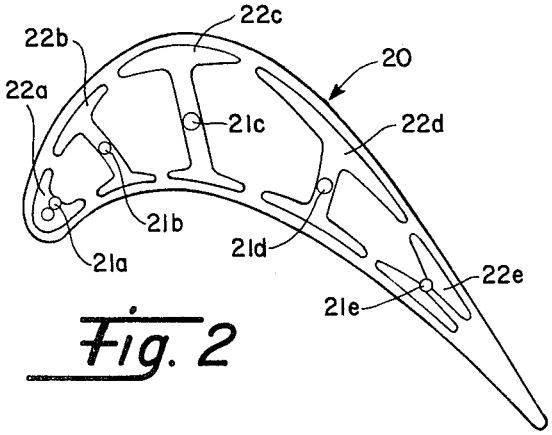
Fig. 2
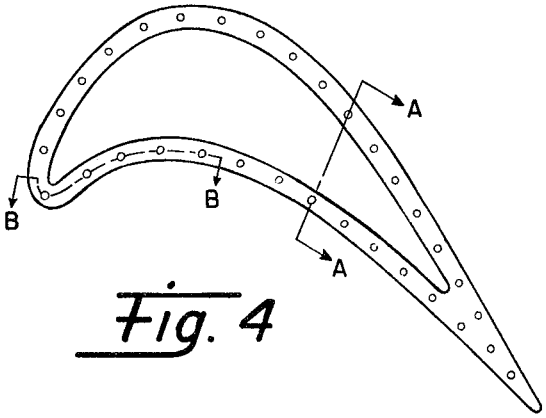
Fig. 4
Fig. 3
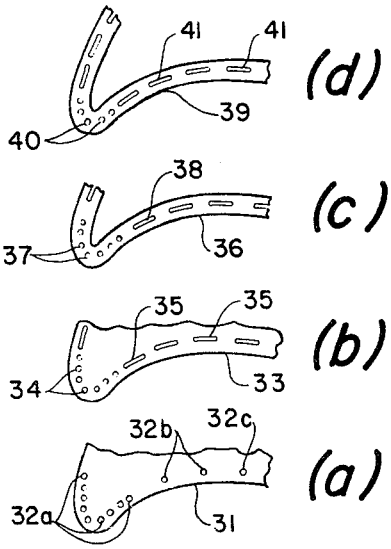
Fig. 6
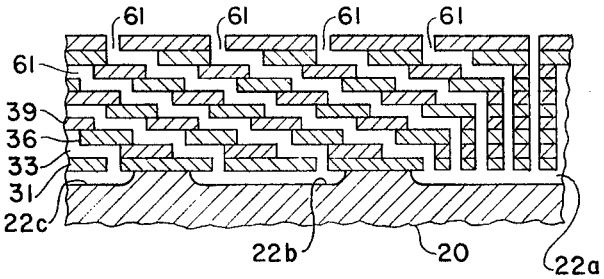
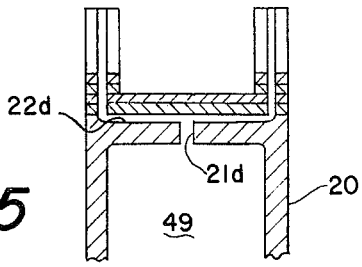
Fig. 5

COOLED TURBINE BLADE TIP CLOSURE

RIGHTS OF THE GOVERNMENT

The invention described herein may be manufactured and used by or for the Government of the United States for all governmental purposes without the payment of any royalty.

BACKGROUND OF THE INVENTION

This invention relates generally to rotor blades for turbine engines, and more particularly to improvements in tip cap configurations for hollow, air cooled turbine rotor blades and method of fabrication thereof.

In the operation of a turbine engine, energy in the form of flow velocity of gaseous reaction products from the combustion chamber of the engine is used to drive the rotor of the turbine by passing the gaseous products against a plurality of turbine blades mounted on the turbine rotor and disposed in the path of the gaseous flow. The temperature of the gaseous combustion reaction products contacting the rotor blades of the turbine is ordinarily in excess of about 2500° F., and engine performance may be optimized in many applications by allowing a high operating temperature for the turbine inlet. In order to provide turbine rotor blades which can withstand these temperatures, it has been found desirable to provide hollow turbine blades which may be cooled by flowing air through the blades. To this end, existing turbine blade configurations have included hollow castings having internal air conducting chambers or passageways having suitable inlets and outlets through which coolant air may be passed. Existing methods for casting hollow rotor blades suitable for turbine blade application, however, ordinarily result in a cast blade which has an open tip end characteristic of the casting process. The blade thus must be provided with a suitable tip end closure to distribute air flow throughout the blade.

Existing tip cap configurations include the one-piece type as disclosed by or referenced in U.S. Pat. No. 3,899,267. This configuration comprises a one-piece tip cap having peripheral impingement cooling holes, and held in place mechanically by peripheral crimping of the blade tip and by brazing. This configuration provides suitable cooling to the blade and tip, but the crimping operation may be unreliable and may be characterized by an undesirably high fabrication reject rate. A two-piece cap configuration such as that described in U.S. Pat. No. 3,982,851 and U.S. Pat. No. 4,010,531 comprises two individual cap portions per blade which have peripheral impingement cooling holes, the cap portions being held in the rotor blade tip by retaining lugs in the blade casting and by brazing. The midchord area of the blade tip of this configuration may receive insufficient cooling which may result in severe distress in the tip area.

The present invention provides a rotor blade tip cap assembly comprising a plurality of layers attached to the tip end of the rotor blade casting, each layer having a plurality of peripheral holes which communicate with each other in the assembled state and with the air passageway internal of the blade casting to define a plurality of outwardly opening torturous, serpentine-shaped coolant passages in the periphery of the assembled tip. A high pressure turbine rotor blade fabricated according to the present invention is characterized by highly efficient cooling capability, minimal thermally induced low cycle fatigue, excellent oxidation resistance, low fabrication costs, and simplicity of manufacture and repair.

It is, accordingly, an object of the present invention to provide an improved turbine rotor blade.

It is a further object of the present invention to provide an efficient and economical tip cap closure for a hollow turbine blade.

These and other objects of the present invention, along with the attendant advantages, will become apparent as the detailed description of certain representative embodiments thereof proceeds.

SUMMARY OF THE INVENTION

In accordance with the foregoing principles and objects of the present invention, an improved high pressure turbine rotor blade and tip cap structure therefor is provided, which comprises, a plurality of metallic layers bonded to the tip end of the blade, each layer having a peripheral shape conforming to the camber of the blade, the layers defining a plurality of radially outwardly opening, serpentine-shaped passageways for passage of coolant fluid through the periphery of the tip end of the blade.

DESCRIPTION OF THE DRAWINGS

The present invention will be more clearly understood from the following detailed description of certain representative embodiments thereof read in conjunction with the accompanying drawings wherein:

FIG. 1 is a perspective view of a turbine rotor blade of the type suitable for the incorporation of the invention herein;

FIG. 2 is an end view of the cambered air foil portion of a hollow turbine blade casting;

FIGS. *3a–d* are views of the leading edges of each of the layers comprising the tip cap configuration;

FIG. 4 is an end view of the rotor blade of FIGS. 1 and 2 having tip cap closure of the present invention installed thereon;

FIG. 5 is a view taken along line A—A of FIG. 4; and

FIG. 6 is a view taken along arcuate line B—B of FIG. 4.

DETAILED DESCRIPTION

Referring now to FIG. 1, shown therein is a perspective view of a typical hollow turbine rotor blade 10 of the type which may be suitable for the incorporation of the invention herein. Blade 10 may comprise a unitary casting including a dovetail 11 having tangs, fir tree or other keyed configuration for mounting within a matching slot on the periphery of the rotor (not shown) of the turbine, and a platform 12 supporting a hollow cambered air foil blade portion 13 presenting a pressure surface 14 and a suction surface 15 to the flow 16 of gaseous combustion products represented schematically by the arrow. In conventional fashion, blade portion 13 may comprise a thin-walled shell including cambered sides 14, 15 defining an interior chamber, and may include suitably placed blade holes 17 in the tip end thereof for the passage of coolant fluid, such as air, through the blade from an inlet port 19 provided in dovetail 11 to the interior chamber of blade 13.

Referring now to FIG. 2, shown therein is a view of the tip end of cambered portion of a rotor blade 20 as cast to provide a blade similar to that of FIG. 1. The blade casting 20 may comprise any of the well known metals or alloys conventionally used in rotor blade construction, and may be cast using conventional casting techniques. The tip end of casting 20 may be configured to include a plurality of restrictor outlet holes 21, depicted in FIG. 2 as holes 21*a–e*, each outlet hole 21 communicating with the internal chambers or passageways of casting 20 for conducting coolant air therethrough. The radially outward facing, tip end surface of casting 20 includes near each restrictor hole 21 a suitably shaped feeder channel 22 depicted in FIG. 2 as channels 22*a–e* near the respective restrictor holes 21*a–e*. Feeder channels 22 may either be formed as an integral part of casting 20 during the casting process, or may be subsequently machined into the tip end surface of casting 20. Restrictor holes 21 and feeder channels 22 are configured such that when a suitable cover plate as hereinafter described is placed over the tip end surface as part of the rotor blade tip construction hereinafter described, channels are defined through which air may be conducted from within the rotor blade through restrictor holes 21 and toward the cambered walls of casting 20 via channels 22. The structure may be better understood by referring to FIG. 5 which shows in part a sectional view of casting 20 including restrictor hole 21*d* and channel 22*d* and a representative casting 20 structure defining an interior air flow chamber 49.

The tip closure of the present invention comprises a plurality of metallic layers or plates of suitable shape conforming to the camber of casting 20 and applied to the tip end of casting 20 to define a plurality of radially outwardly opening, coolant passageways through the tip end of the blade in the periphery of the tip cap closure structure. Referring now to FIG. 3, a representative set of layers which, in the assembled condition, provide the desired structure, are shown individually and in partial sectional views. Each layer represented in FIGS. 3*a–d* has a total overall shape conforming to the overall cambered shape of the tip end of casting 20, and each layer has a plurality of suitably located holes around the periphery thereof substantially shown which comprise the coolant passageways through the tip end of a finished rotor blade when the layered structure is bonded to the tip end of casting 20 as herein described. As shown in FIG. 3*a* the first applied layer 31 comprises a substantially solid layer or plate for covering the tip end of casting 20 and includes a plurality of holes 32 around the periphery thereof which register with the extremities of the respective channels 22 in the tip end of casting 20. For example, the holes labelled 32*a* in the configuration presented in the figures may be configured to register and communicate with feeder channel 22*a* in the end wall of casting 20. Likewise, holes labelled 32*b* and 32*c* may, respectively, communicate with feeder channels 22*b* and 22*c* of casting 20. The remainder of the periphery (not shown) of plate 31 likewise contains suitable holes 32 registering and communicating, respectively, with the peripheral extremities of the remainder of the feeder channels 22. As an alternative to the channels 22 provided in the end wall of casting 20, a casting 20 having a substantially flat end wall defining outlet holes 21 could be provided and a plate 31 having channels in the surface thereof contacting casting 20 could be used to provide the desired channels through which outlets 21 and holes 32 could communicate.

As shown in FIG. 3*b*, a second plate 33 may be included. A desirable plurality of circular cooling holes 34 is provided near the leading edge thereof to register with corresponding holes 32 in plate 31, and an appropriate plurality of elongate holes 35 are spaced around the remainder of the periphery of plate 33. Each elongate hole 35 is positioned to communicate at a first end thereof with a corresponding cooling hole 32 in plate 31 when plate 33 is applied thereover. One or more plates 31, 33, may be used in a desired tip end structure, or, alternatively, plate 33 may have a marginal configuration such as described below for the remainder of the layers of the structure. Each plate 31, 33 may for the intended purpose be from about 0.030 cm to about 0.040 cm in thickness.

The remainder of the tip cap structure comprises a plurality of marginal layers 36, 39 applied around the periphery of the assembly to build up a hollow tip end configuration for the finished rotor blade. Any desired number of such layers may be used in order to provide a tip end assembly of desired height, each layer having thickness similar to that of plates 31, 33. Layer 36 has around its periphery a plurality of holes 37 on its leading edge registering with corresponding holes 34 in plate 33, and a plurality of elongate holes 38 spaced around the remainder of the periphery thereof. A first end of each elongate hole 38 is configured to register with the second end of a corresponding elongate hole 35 in the previous layer. Marginal plate 39, shown in FIG. 3*d*, includes a plurality of holes 40 in its leading edge registering with corresponding holes 37, and a plurality of elongate holes 41 spaced around the remainder of its periphery. Each elongate hole 41 is positioned to communicate at a first end thereof with the second end of a corresponding elongate hole 38 in the previously applied layer 36. Additional marginal layers may be further applied until the desired height of the hollow tip end structure for the rotor blade is achieved.

Referring now to FIG. 4, the last such layer applied may include a plurality of circular holes respectively communicating with the second ends of the elongate holes of the layer previously applied, and which provides a finishing layer of the tip end configuration of the present invention.

FIG. 6 shows a sectional view of the finished tip cap configuration of the FIG. 4 taken along arcuate line B—B. As shown therein, the layered structure includes a plurality of layers such as that suggested in FIGS. 3*a–d*, and bonded together and to the end wall of casting 20. The finished structure provides a plurality or serpentine-shaped coolant passages 61 communicating with respective feeder channels 22. It is thus seen that the torturous paths presented to the airflow from feeder channel 22 out through the tip structure built up as described provides highly efficient cooling to a rotor blade tip to which the structure of the present invention is applied.

Each layer comprising the tip cap structure may be cast or machined from any of the well known metals or alloys conventionally used in turbine rotor blade construction and which display suitable physical, thermal, and mechanical properties consistent with the environment to which they are exposed within a turbine engine. Therefore, material selection for each of the layers comprising the tip cap assembly of the present invention is not considered as limiting of the teachings herein contained.

A high pressure turbine blade having a tip cap attached thereto according to the present invention may be fabricated as follows. The desired number and configuration of layers, such as suggested in FIGS. 3–6 are each provided with the desired peripheral holes by machining, drilling, etching or like processes. A thin layer of bonding agent, such as a boronized foil (0.0015 in thick) is then applied to all interfacing surfaces of the layers and the layers are then joined by high temperature activated diffusion bonding at about 2150°–2200° F. at about 45 psi, depending on the selected material for the layers, to form a tip assembly having the desired serpentine passageways near the periphery thereof. The bonding agent is then applied to the top surface of the blade casting and the layered assembly is activated diffusion bonded thereto, to form the assembly suggested in FIG. 5.

A rotor blade fabricated as just described is characterized by highly reliable, low stress bonded joints. Further, the layered assembly of the present invention enjoys the distinct advantage over previously disclosed configurations in that a blade fabricated as disclosed herein may be easily repaired in the event of tip failure. For example, the tip of a damaged, out-of-specification or otherwise unacceptable rotor blade may be replaced simply by machining the layers comprising the unacceptable tip to expose the casting (e.g., casting 20 of FIG. 2). A new layered tip cap assembly may then be applied according to the procedure just described to provide a high quality blade.

The present invention, as hereinabove described in certain representative embodiments thereof, therefore provides an improved tip end closure for a hollow, cast turbine rotor blade. It is understood that certain modifications to the structure and assembly procedure for the tip end closure of this invention may be made as might occur to one with skill in the field of this invention, within the scope of the teachings. Therefore, all embodiments contemplated hereunder have not been shown in complete detail. Other embodiments may be developed without departing from the spirit of this invention or from the scope of the appended claims.

We claim:

1. An improved rotor blade for a turbine engine which comprises:

a. a hollow casting including a dovetail at the radially inward end thereof providing means for mounting said blade to the rotor of said turbine, and a cast end wall at the radially outward end thereof, said casting having cambered side walls defining an interior chamber having an inlet near side dovetail and an outlet through said end wall for passage of coolant fluid through said blade;

b. a tip end closure for said blade bonded to said end wall of said casting, said tip end closure comprising a plurality of metallic layers, each layer having a peripheral shape conforming to the camber of said side walls;

c. the first said layer adjacent said end wall comprising a metallic plate defining a plurality of holes around its periphery, and means defining a plurality of channels on the surface thereof confronting said end wall and communicating with said peripheral holes and said outlet, for conducting said coolant from said outlet toward said side walls;

d. the remainder of said layers comprising a plurality of marginal plates each having peripheral blades registering with respective peripheral holes in adjacent plates and communicating with said holes in said first plate; and e. said layers defining a plurality of radially outwardly opening passageways near the periphery of said tip end closure, communicating with said outlet, for passage of said coolant fluid through said tip end closure.

2. An improved rotor blade for a turbine engine which comprises:

a. a hollow casting including means at the radially inward end thereof for mounting said blade to the rotor of said turbine, and a cast end wall at the radially outward end thereof, said casting having cambered side walls defining an interior chamber having an inlet near said mounting means and an outlet through said end wall for passage of coolant fluid through said blade;

b. said cast end wall including a plurality of channels in the radially outward surface thereof for conducting said coolant from said outlet toward said side walls of said casting;

c. a tip end closure for said blade bonded to said end wall of said casting, said tip end closure comprising a plurality of metallic layers, each layer having a peripheral shape conforming to the camber of said side walls, the first said layer adjacent said end wall comprising a metallic plate defining a plurality of holes around its periphery, the peripheral extremities of said channels communicating with the peripheral holes in said plate;

d. the remainder of said layers comprising a plurality of marginal plates each having peripheral holes registering with respective peripheral holes in adjacent plates and communicating with said holes in said first plate to define a plurality of radially outwardly opening passageways near the periphery of said tip end closure, communicating with said outlet, for passage of said coolant fluid through said tip end closure of said blade.

3. The rotor blade as recited in claim 2 wherein each said marginal plate has elongate peripheral holes in offset registering alignment with holes in adjacent plates to define a plurality of serpentine-shaped, radially outwardly opening, passageways in the periphery of said tip end closure.

4. The rotor blade as recited in claim 1 wherein each said marginal plate has elongate peripheral holes in offset registering alignment with holes in adjacent plates to define a plurality of serpentine-shaped, radially outwardly opening passageways in the periphery of said tip end closure.

5. In a hollow turbine rotor blade having cambered side walls defining an internal chamber, and an inlet in its radially inward end and an outlet in its radially outward end wall, for passage of coolant fluid through said blade, a tip end closure bonded to said outward end wall of said blade, said closure comprising:

a. a plurality of metallic layers, each layer having a peripheral shape conforming to the camber of said side walls, the first said layer adjacent said end wall comprising a metallic plate defining a plurality of holes around its periphery, and means defining a plurality of channels on the surface thereof confronting said end wall and communicating with said peripheral holes and said outlet, for conducting said coolant from said outlet toward said side walls; and b. the remainder of said layers comprising a plurality of marginal plates each having peripheral holes registering with respective peripheral holes in adjacent plates and communicating with said holes in said first plate and defining a plurality of radially outwardly opening passageways near the periphery of said tip end closure and communicating with said outlet for passage of said coolant fluid through said tip end closure.

6. In a hollow turbine rotor blade having cambered side walls defining an internal chamber, and an inlet in its radially inward end and an outlet in its radially outward end wall, for passage of coolant fluid through said blade, a tip end closure bonded to said outward end of said blade, said closure comprising:

a. a plurality of metallic layers, each layer having a peripheral shape conforming to the camber of said side walls, the first said layer adjacent said end wall comprising a metallic plate defining a plurality of holes around its periphery;

b. said outward end wall including means defining a plurality of channels in the radially outward surface thereof for conducting said coolant from said outlet toward said side walls, the peripheral extremities of said channels communicating with the peripheral holes in said plate; and c. the remainder of said layers comprising a plurality of marginal plates each having peripheral holes registering with respective peripheral holes in adjacent plates and communicating with said holes in said first plate to define a plurality of radially outwardly opening passageways communicating with said outlet for passage of said coolant fluid through said tip end closure of said blade.

7. The rotor blade as recited in claim 6 wherein each marginal plate has elongate peripheral holes in offset registering alignment with holes in adjacent plates to define a plurality of serpentine-shaped, radially outwardly opening, passageways in the periphery of said tip end closure.

8. The rotor blade as recited in claim 7 wherein adjacent layers are joined by high temperature activated diffusion bonding, and said tip end closure comprising said layers is joined to said cast end wall by high temperature activated diffusion bonding.

* * * * *